United States Patent [19]

Fleishman

[11] 4,202,581

[45] May 13, 1980

[54] SUPPORT MEANS FOR PORTABLE FURNITURE

[76] Inventor: Gregg Fleishman, 6071 Hargis St., Los Angeles, Calif. 90034

[21] Appl. No.: 866,837

[22] Filed: Jan. 4, 1978

[51] Int. Cl.[2] ..... A47C 7/00

[52] U.S. Cl. ..... 297/440; 108/159; 297/446; 297/447

[58] Field of Search ..... 5/DIG. 1; 46/15; 108/159, 161; 248/174, 459, 460; 297/440, 442, 443, 446, 447

[56] References Cited

U.S. PATENT DOCUMENTS

| | | | |
|---|---|---|---|
| 2,439,690 | 4/1948 | Lippenberger | 248/174 X |
| 2,530,924 | 11/1950 | Turner | 5/DIG. 1 |
| 2,616,773 | 11/1952 | Sanford | 108/159 |
| 2,642,118 | 6/1953 | Lamb | 297/447 X |
| 2,649,147 | 8/1953 | Sanford | 297/447 X |
| 2,670,787 | 3/1954 | Vandas et al. | 297/447 X |
| 2,881,824 | 4/1959 | Herrmann | 297/446 X |

FOREIGN PATENT DOCUMENTS

| | | | |
|---|---|---|---|
| 1218468 | 12/1959 | France | 46/15 |
| 638200 | 5/1950 | United Kingdom | 297/447 |

*Primary Examiner*—James C. Mitchell
*Attorney, Agent, or Firm*—Lyon & Lyon

[57] ABSTRACT

A planar one-piece support member having a tab member adapted to be disposed outwardly from the plane of said support member to define a bifurcated structure which enables the support of portable furniture, such as table and chairs, said support member being provided with means to enable said support member to be releasably secured to said furniture in order to enable said support member to return to its original planar shape to facilitate portability.

10 Claims, 10 Drawing Figures

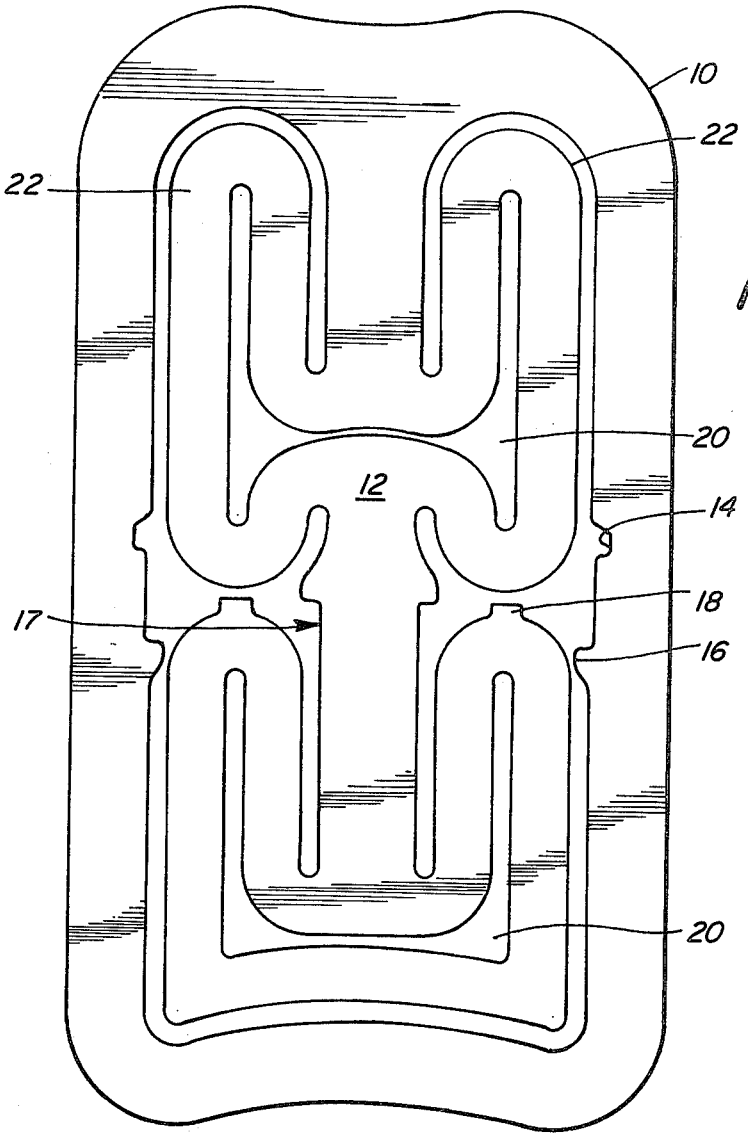
FIG. 1
FIG. 2
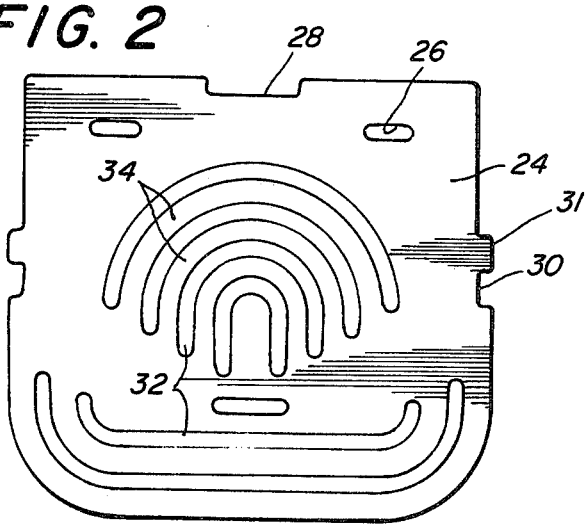
FIG. 3
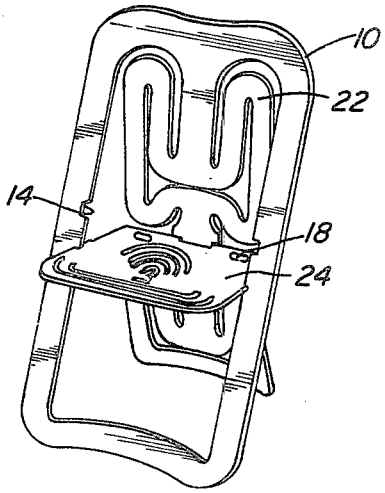

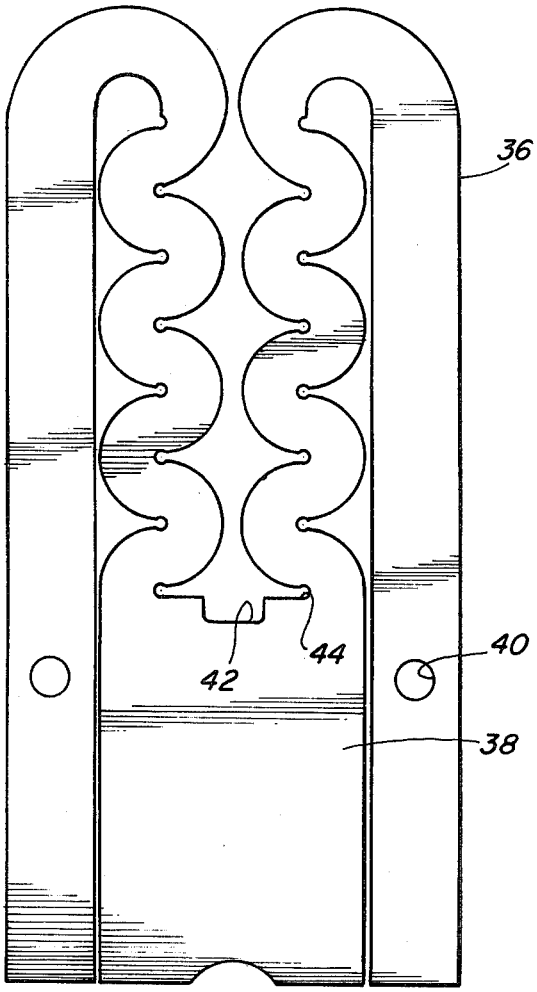
FIG. 4
FIG. 5
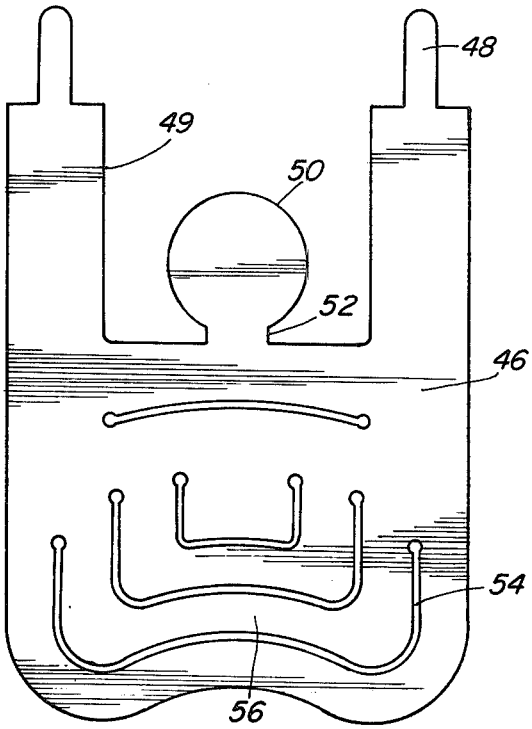
FIG. 6
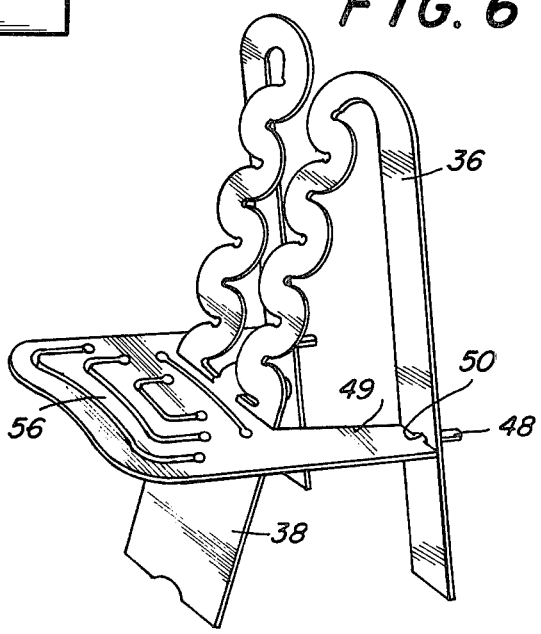

FIG. 7
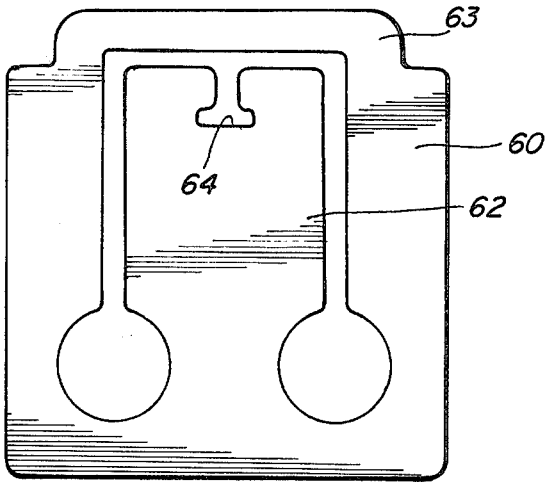
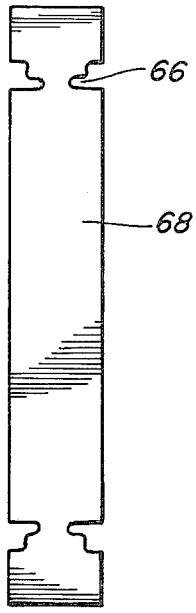
FIG. 9
FIG. 8
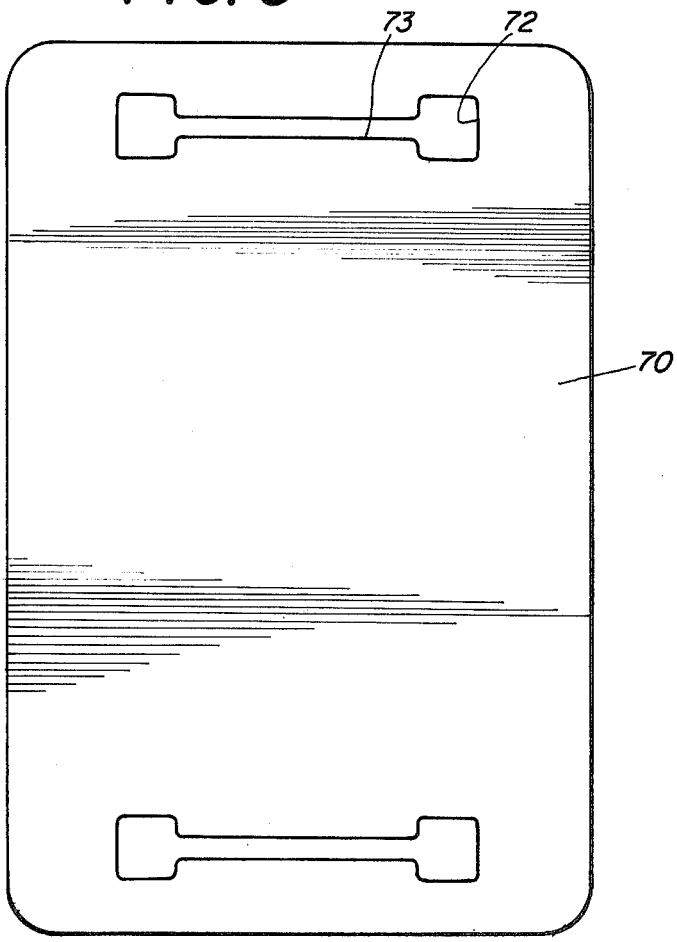
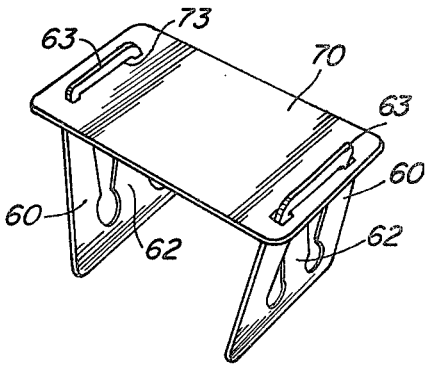
FIG. 10

SUPPORT MEANS FOR PORTABLE FURNITURE

BACKGROUND OF THE INVENTION

The present invention relates to portable furniture and in particular relates to a support member for portable furniture.

Portable furniture is furniture which is constructed in such a manner to facilitate frequent transportation of the furniture to a number of locations. Further, portable furniture is normally constructed to enable easy storage of the furniture. To facilitate transportation and storage of portable furniture, such furniture in the past has been constructed in such a manner to enable folding of the furniture into a generally planer structure. For example, portable tables are provided with pivotally mounted legs which enable the legs to be rotated into the plane of the table top. Folding chairs are constructed in such a manner to enable the seat and the front legs to be moved into the plane of the back of the chair to form a generally planer structure. However, in some cases, the pivot joints of the furniture becomes defective thereby preventing a folding of the chair and making the transportation and storage of the furniture more difficult. Further, the complex nature of folding furniture increases the cost of the furniture.

SUMMARY OF THE INVENTION

It is therefore an object of the present invention to provide improved portable furniture. It is a further object of the present invention to provide an improved support member for portable furniture.

These and other objects and advantages are obtained by forming a generally planer one-piece support member having a tab member adapted to be disposed outwardly from the plane of the support member to define a bifurcated structure which enables the support of portable furniture. In its preferred embodiment, the support members is utilized with portable chairs and portable tables. For portable chairs, the support member is provided with means to enable a chair seat to be releasably secure to the support member when it is disposed in its bifurcated mode. Portable tables are provided with two support members each of which are provided with means to enable the support members to be releasably secured to the table tops when the support members are disposed in the bifurcated mode. The table is also preferably provided with a retaining bar which is releasably secured to the tab members of both support members and functions to maintain the support members in the bifurcated mode.

The tab member is preferably provided with means to relieve some of the stress encountered when the support member is disposed in the bifurcated mode. In one embodiment, the stress relief means comprises a pair of spaced apart opposing loops.

BRIEF DESCRIPTION OF DRAWINGS

A more thorough disclosure of the objects and advantages of the present invention is presented in the detailed description which follows and from the accompanying drawings of which:

FIG. 1 is a plan view of a support member according to the present invention.

FIG. 2 is a plan view of a chair seat for use with the support member of the present invention.

FIG. 3 is a perspective view of an assembled chair formed according to the present invention.

FIG. 4 is a plan view of an alternative embodiment of the support member of the present invention.

FIG. 5 is a plan view of a chair seat for use with the alternative embodiment of the support member of the present invention.

FIG. 6 is a perspective view of an assembled chair formed according to the present invention.

FIG. 7 is a plan view of another alternative embodiment of the support member of the present invention.

FIG. 8 is a plan view of a table top for use with the support member of the present invention.

FIG. 9 is a plan view of a retaining member for use with the support member of the present invention.

FIG. 10 is a perspective view of an assembled table formed according to the present invention.

DETAILED DESCRIPTION OF THE INVENTION

The invention contemplates the formation of a generally planer one-piece support member for portable furniture. The support member is provided with a tab member which is adapted to be angularly disposed from the plane of the support members to define a bifurcated structure which enables support of furniture. The drawings illustrate the preferred embodiment of the support member according to the present invention. Referring to FIGS. 1–3, there is shown a portable chair formed according to the present invention. In FIG. 1, there is shown a one-piece support member 10 having a centrally disposed tab member 12. Support member 10 is also provided with notch 14 and protrusions 16. Tab member 12 is provided with neck 17 and upstanding fingers 18. Further, tab member 12 has a plurality of slots 20 formed therein which define loops 22. The slots 20 and loops 22 function to reduce the stress on the support member when it is disposed in the bifurcated mode.

The support member is comprised of a flexible material such as wood, plastic or metal. A suitable material is Finnish birch plywood. However, it will be obvious to one skilled in the art that other suitable material may also be utilized in the practice of the present invention.

Referring to FIG. 2, there is shown a chair seat 24 for use with support member 10. The chair seat 24 is provided with apertures 26, channel 28 and groove 30 and bump 31. The chair seat is also provided with a plurality of generally centrally located slots 32 which define a plurality of semicircular ribs 34. Upon the application of pressure to the face of the chair seat 24, the ribs deform inwardly in a concave manner. The deformation enables the seat to conform more closely to the profile of the individual seating thereon. This makes the seat more comfortable to the individual. If desired, the seat may be provided with a center support means wherein with the application of pressure, the seat will deform into a generally saddle-shaped configuration.

To assemble the chair, fingers 18 are pulled forward of neck 17 of tab 12. Chair seat 24 is then positioned from above until it fits in between fingers 18 and neck 17 such that apertures 26 of seat 24 are in line with fingers 18 of tab 12. The seat is then pivoted downwardly as it is pushed backwardly until Bump 31 passes through Notch 14 of Member 10. The chair seat is again pivoted downwardly until the groove 30 of the seat engages outwardly extending protrusion 16 to secure the seat to the support member 10. When assembled, the support member is disposed in its bifurcated mode and the chair seat is releasably secured to and supported by support member 10. The loops 22 of the tab member 12 also function to form the back of the chair.

Referring to FIGS. 4–6, there is shown an alternative embodiment of a portable chair formed according to the present invention. The support member 36 is similarly formed with a tab member 38 and is provided with aperture 40. The tab member 38 is provided with notch 42 and a slot 44.

Referring to FIG. 5, the chair seat 46 is provided with outwardly extending fingers 48, channel 49 and generally rounded protrusion 50 having neck 52. The chair seat is similarly provided with a plurality of slots 54 which define a plurality of generally semicircular ribs 56. The ribs similarly function to deform inwardly with the application of pressure to provide greater comfort.

To assemble the chair, fingers 48 of seat 46 are inserted into apertures 40 of member 36. Tab member 38 is then pulled forward into channel 49 of seat 46 until protrusion 50 passes through slot 44 of tab 38. The seat is then pushed downwardly forcing neck 52 of protrusion 50 into notch 42 of tab 38 thereby removably securing the seat to the support member 36 and forming the assembled chair.

Referring to FIGS. 8–10, there is shown the preferred embodiment of a table formed according to the present invention. The support member 60 for the table is similarly formed with tab member 62 and is also provided with flange 63. The tab member is provided with a slot 64, which is capable of being releasably secured to the opposing notches 66 of retaining member 68 shown in FIG. 9.

Referring to FIG. 8, the table top 70 comprises a generally planer rectangular structure having two generally dumbell-shaped slots 72 formed at either end thereof. The slots are provided with lips 73.

To assemble the table, flanges 63 of support members 60 are inserted to each of the slots 72 of table top 70. The flange 63 is then positioned over lip 73 of the table top 70. The tabs 62 of each of the members 60 are deformed inwardly towards each other. Opposing notches 66 of retaining member 68 are then inserted into each of the slots 64 of tabs 62 of the members 60. Since the retaining member 68 is shorter than the table top 70, when the table is assembled, the tabs 62 of the respective support members 60 are releasably retained in their inwardly deformed position. The retaining member thus maintains both support members in the bifurcated mode and also functions to bias the flange 63 of the support members over lips 73 of the table top. Preferably, the top of the tabs 62 are contiguous to the table top thereby providing additional support for the table top.

While embodiments and applications of this invention have been shown and described, it will be apparent to those skilled in the art that many more modifications are possible without departing from the inventive concepts herein described. For example, it would be obvious to one skilled in the art to provide other means to releasably secure the support member to the furniture. The invention, therefore, is not to be restricted except as is necessary by the prior art and by the spirit of the appended claims.

I claim:

1. A collapsible chair assembly comprised of:

a seat member;

a generally planar, one-piece support member made of flexible material having a back portion and a tab portion adapted to be unfolded away from the plane of said back portion to define a bifurcated structure;

said seat member having first mounting means adapted to be engaged with corresponding second mounting means positioned on the back and tab portion of the support member and adapted to maintain said back and tab portions in a spaced configuration;

said corresponding second mounting means releasably engaging and supporting said seat member by and between said back and tab portions.

2. The chair assembly described in claim 1 wherein said back portion and said seat member have a plurality of voids for flexibility.

3. The chair assembly described in claim 2 wherein the voids are curvilinear and define a circuitous and extended stress path extending from said back portion to said tab portion.

4. A portable table assembly comprised of:

a table top having at least two slots;

at least two generally planar one-piece support member assemblies made of flexible material and adapted to be releasably secured of said table top; and each support member assembly having a back portion adapted to engage with said slots in the table top and a tab portion adapted to be unfolded away from the plane of said back portion and having attachment means at each end thereof;

a retaining member having securing means at each end thereof and adapted to engage with the attachment means located in the tab portion of each one-piece support member assemblies; each tab portion adapted to be maintained in a spaced configuration vis-a-vis the back portion by being releasably connected by said retaining member to the tab portion of at least one other support member.

5. A collapsible chair comprising:

a seat member;

a one-piece support assembly made of flexible material having a front and rear member;

said seat member having mounting means adapted to releasably engage with securing means located on said front and rear members of said one-piece support assembly and adapted to hold said first and rear members in a spaced configuration;

said front and rear members having securing means adapted to mate with the mounting means in said seat member and releasably connecting and supporting said seat member therebetween;

said rear member being in a plane substantially perpendicular to said seat member;

said rear member and seat member having a plurality of curvilinear voids therein for flexibility;

said front and rear member being adapted to collapse into a substantially planar configuration when said seat member is disengaged and removed from therebetween.

6. The chair assembly described in claim 5 wherein the positioning of the curvilinear voids define a circuitous and extended stress path extending from said rear portion to said front portion.

7. A collapsible chair comprising:

a seat member;

a one-piece support assembly for said seat member made of flexible material having a front member and a rear member;

said seat member having mounting means adapted to releasably engage with securing means on the front and rear members of the support assembly and adapted to maintain said front and rear members in a spaced configuration;

said front and rear members having securing means adapted to mate with the mounting means in said seat member and, releasably connecting and supporting said seat member therebetween;

said front member being in a plane substantially perpendicular to said seat member;

said front member and said seat member having a plurality of curvilinear voids therein for flexibility;

said front and rear members being adapted to collapse into a substantially planar configuration when said seat member is disengaged and removed therebetween.

8. Portable furniture including furniture member means and a generally planar support member, said furniture member means disposed generally horizontally and said support member disposed generally vertically, said support member comprising integral main and tab portions adapted to be resiliently disposed in angular relation, said support member having an upwardly facing portion supporting said furniture member means, said furniture member means having separate interlocking means releasably engaging said main portion and said tab portion for maintaining said angular relation, and said furniture member means and support member being selectively separable for portability by disengaging said interlocking means.

9. The portable furniture of claim 8 wherein said furniture member means is a chair seat.

10. Portable furniture including a table top means, at least one furniture member means and at least one generally planar support member;

each furniture member means disposed generally horizontally and each support member disposed generally vertically;

each support member comprising integral main and tab portions adapted to be resiliently disposed in angular relation;

each support member having an upwardly facing portion supporting a furniture member means;

each furniture member means having separate interlocking means releasably engaging the main portion and said tab portions for maintaining said angular relation;

each furniture member means and each support member being selectively separable for portability by disengaging said interlocking means;

said table top means having a second interlocking means releasably engaging the main portion of each support member, said table top means being supported by at least one support member, said support member and table top means being selectively separable for portability by disengaging said second interlocking means.

* * * * *